US007318300B1

(12) United States Patent
Seavy

(10) Patent No.: US 7,318,300 B1
(45) Date of Patent: Jan. 15, 2008

(54) MODULARIZED JAIL CELL

(76) Inventor: Richard Jay Seavy, 180 Air Park Dr., Wilsonville, AL (US) 35186

( * ) Notice: Subject to any disclaimer, the term of this patent is extended or adjusted under 35 U.S.C. 154(b) by 456 days.

(21) Appl. No.: 10/743,661

(22) Filed: Dec. 22, 2003

(51) Int. Cl.
*E04H 3/08* (2006.01)

(52) U.S. Cl. ..... 52/106

(58) Field of Classification Search ..... 52/79.1, 52/270, 284, 285.1, 586.1, 79.13, 271
See application file for complete search history.

(56) References Cited

U.S. PATENT DOCUMENTS 1,100,804 A * 6/1914 White ..... 52/32
2,054,665 A * 9/1936 Tracy ..... 52/461
3,229,431 A * 1/1966 Paul ..... 52/79.13
3,377,755 A * 4/1968 Meuli et al. ..... 52/79.13
4,434,516 A 3/1984 Morris et al.
4,599,829 A 7/1986 DiMartino, Sr.
4,843,788 A * 7/1989 Gavin et al. ..... 52/205
2004/0237450 A1* 12/2004 Barborka ..... 52/633
2004/0261326 A1* 12/2004 Thomason et al. ..... 52/79.1

* cited by examiner

*Primary Examiner*—Richard E. Chilcot, Jr.
*Assistant Examiner*—Jessica Laux
(74) *Attorney, Agent, or Firm*—Russell Carter Gache Sirote & Permutt, P.C.

(57) ABSTRACT

A modularized jail cell having front and rear panels, two side panels connecting the front and rear panels, and a roof panel connecting the front rear and side panels. Each cell includes vertical support members oriented to provide both vertical and lateral support for each panel, and the roof panel is also adapted to serve as a floor for a second modularized jail cell positioned above the first or lower modularized jail cell. One or more cells may be connected horizontally and a system of cells may be constructed by attaching cells laterally and vertically to create a jail cell complex. Inter-connecting structures are present at the juncture of each panel to facilitate connection with an adjacently positioned cell. Front interlock plates and rear cover plates secure each laterally positioned cell together.

23 Claims, 7 Drawing Sheets

MODULARIZED JAIL CELL

FIELD OF THE INVENTION

The present invention relates generally to the construction of modular structures and jail cell construction. In greater particularity the present invention relates to interlocking stackable and repeatable cells that may be utilized to construct a jail call complex.

BACKGROUND OF THE INVENTION

In recent years there has been a substantial increase in the population of prison inmates in our prison systems across the country. Prisons have become overcrowded with jail inmates, and some of the current jails house more prisoners per cell than the amount of inmates for which each jail cell was designed. This causes prison population instability and dangerous overcrowding. Further, the costs for managing such dense populations increases due to the increased number of security systems and prison guards required to manage such an overcrowded situation.

One reason for current prison inmate overcrowding is that, generally, state constituents refuse to allocate additional tax dollars for the purpose of housing and protecting inmates and the general distaste for spending money on law breakers. The required tax increases stem also, in part, from the dramatic rise in costs for building additional prisons, and the lengthy construction time required to construct such prison systems.

In response, various construction companies have attempted to prefabricate portions of prisons and install them on location in accordance with preselected specifications. While the construction industry has migrated from on-site, custom fabrication of user specified dwellings to prefabricating dwelling portions that are connected and interlocked on location in accordance with standardized designs, the construction of prison systems has not fully embraced these advances in prefabrication. For instance, the shipping container industries and government housing construction industries have migrated to 60% or more of preconstructed materials, prison construction projects utilize far less prefabricated portions. This may be due to the fact that construction of prefabricated cells for prison systems have different requirements than nominal population living quarters. Security concerns, ventilation and sanitation density, systematic and controlled entrance way requirements, and internal safety and security for multiple inmate enclosures, all contribute to making the design of a prefabricated cell complicated and, generally, expensive.

Therefore, what is needed in today's prison systems is a prefabricated prison cell that allows for relatively inexpensive fabrication and structures for interlocking multiple cells on-site in a convenient and efficient manner.

SUMMARY OF THE INVENTION

The invention consists of a modularized jail cell having front and rear panels, two side panels connecting the front and rear panels, and a roof panel connecting the front rear and side panels. The roof panel is also adapted to serve as a floor for a second modularized jail cell positioned above the first or lower modularized jail cell. Two cells may also be connected horizontally.

Other features and objects and advantages of the present invention will become apparent from a reading of the following description as well as a study of the appended drawings.

BRIEF DESCRIPTION OF THE DRAWINGS

A modularized jail cell incorporating the features of the invention as depicted in the attached drawings which form a portion of the disclosure wherein.

DESCRIPTION OF THE PREFERRED EMBODIMENTS

Figure 1:
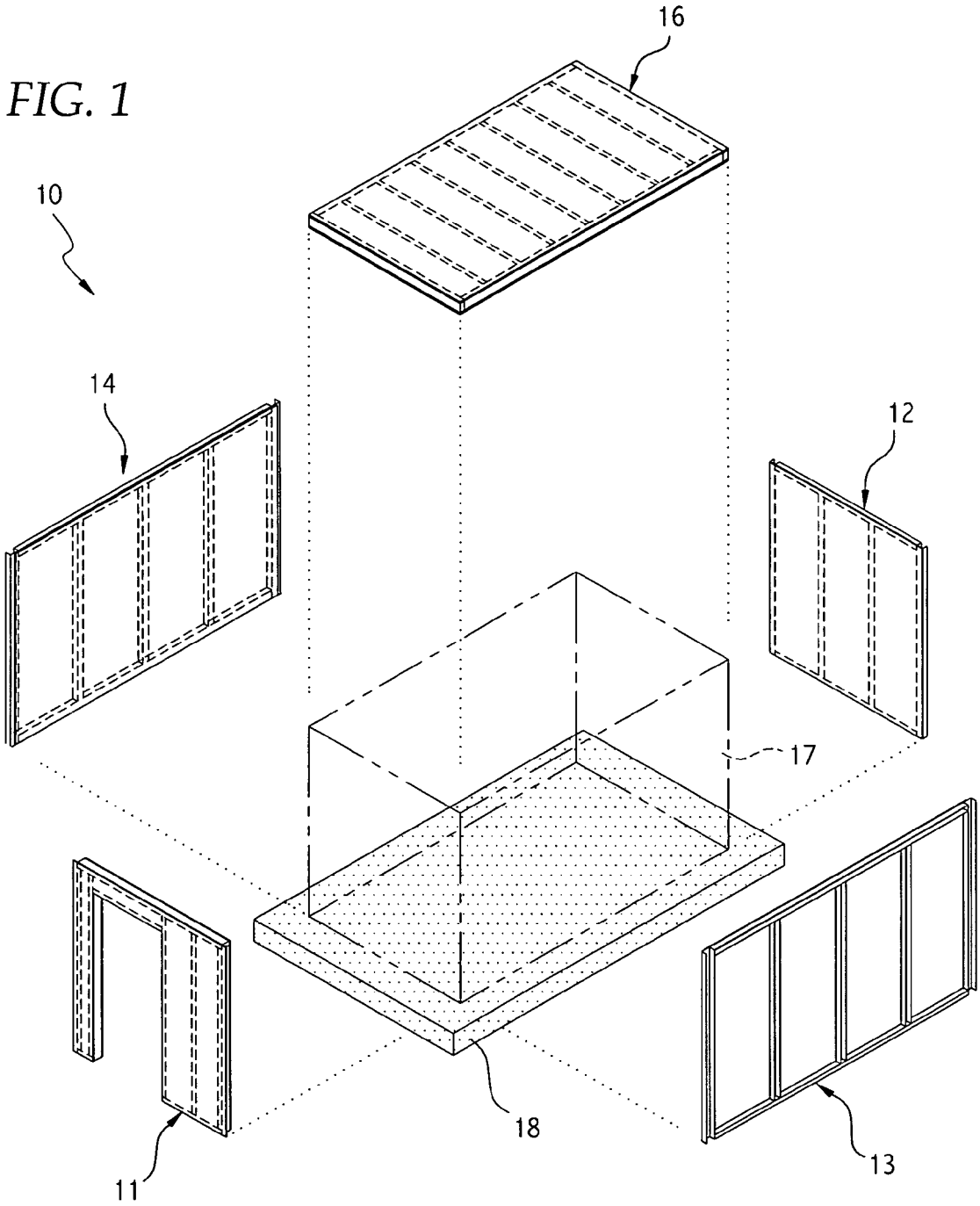
FIG. 1 is an exploded view of the modularized jail cell invention.

Referring to the drawings for a better understanding of the function and structure of the invention, the invention is shown generally at 10 and for illustrative purposes is shown positioned upon a concrete slab 18 which is not part of the invention. The front panel 11 and rear panel 12 are connected at their sides via right and left side panels 13 and 14, and a roof panel 16 connects each of these at their upper edges. Invention 10 is generally box shaped 17 to allow for repeatable cell creation and includes mechanisms for connecting other cells 10 on either the top, bottom, or sides of a first cell. Various vertical support members provide vertical support to each of the panels and provides stiffness to the metal skin of each panel. Front panel 11 and roof panel 16 include double wall surface construction while all other panels utilize single wall construction. Optionally, depending upon multi-cell construction orientation, roof panel 16 may also consist of single wall construction when such a roof section is not utilized by a superiorly positioned cell to provide a floor.

Figure 2A:
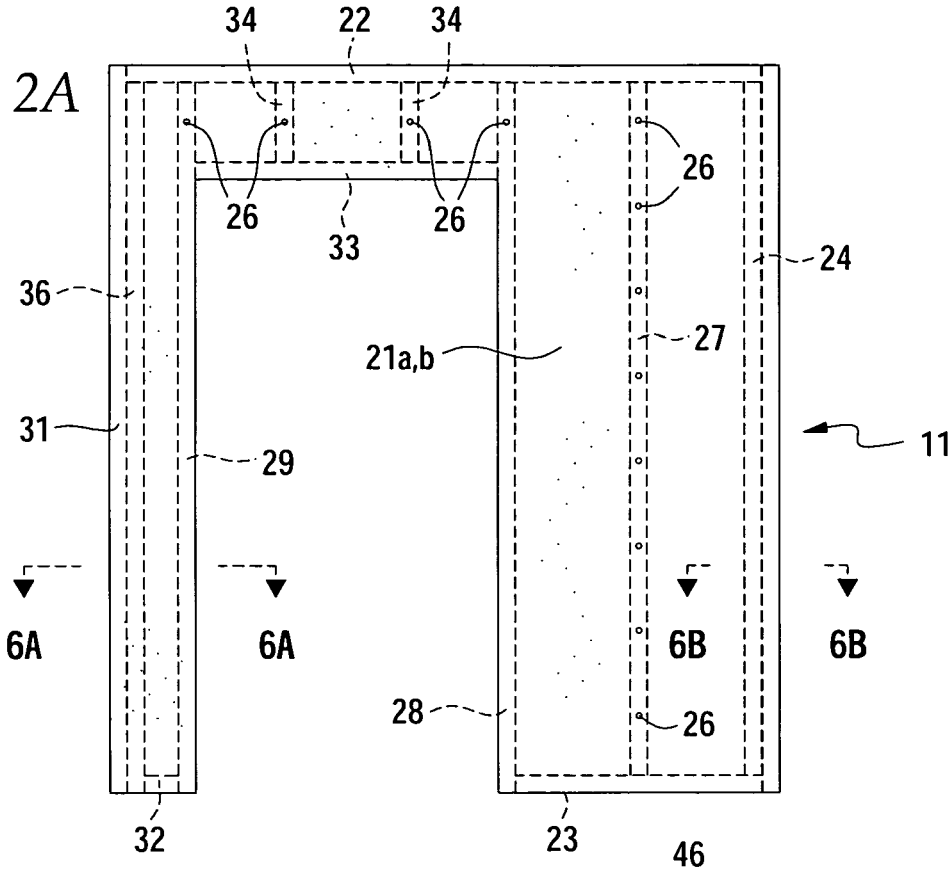
FIG. 2A is an elevational view of the front panel of the invention viewed from the interior of the cell.

Referring now to FIG. 2A, it may be seen that front wall 21*a* presents a smooth and continuous front surface to the interior of a constructed cell 10. Walls 21*a,b* are typically fabricated from 3/16 inch, A-36 grade, plate steel suitable for painting and welding. Various types of support members are oriented horizontally and vertically across front wall 21*a* and affixed thereto, and to each other, via standard welding techniques. Upper support member 22 is welded to exterior surface 21*b* at an upper edge thereof. All support members utilized in invention 10 are elongated "C" channel type and are also constructed of 3/16 inch plate steel and are preferably 6 inches wide. Lower channel support members 23 and 32 provide base support for front panel 11 and also provide base support for channel support members 24, 27, 28, 29 and 36. Vertical support members 27, 28, 29 and 30 are welded to the outer surface of interior wall 21*a* at suitable contact points utilizing known welding techniques and are welded to outer wall 21*b* with plug welds that are applied via holes 26 drilled through outer wall 21*b* and spaced at interval points coinciding with the position of support members 27, 34, and the top portion of 29. Additional channel members 34 are bounded by upper support member 22 and upper door frame support member 33 to form header portions for the door entrance of front panel 11. As may be seen, wall 21 extension portion 31 extends beyond support member 36 to provide a supporting connection surface with side panels 13 and 14, as will be discussed further. The same type of extension portion appears outside of support member 24.

Figure 2B:
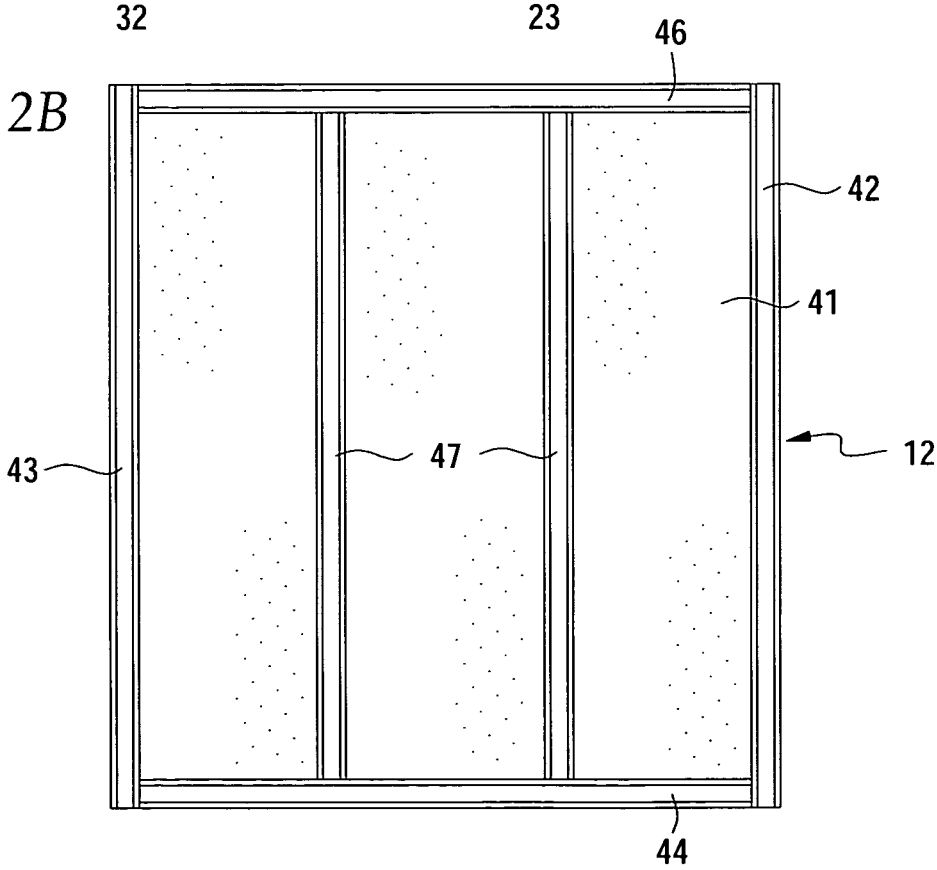
FIG. 2B is an elevational view of a rear panel of the invention viewed from the exterior of the cell.

Referring now to FIG. 2B for the structure of the rear panel 12, upper support member 46 and lower support member 44 are welded onto the extension of wall surface 41 and are separated and supported by central support members 47. Side support members 42 and 43 bear against upper and lower support members 44, 46 at their ends. Each of the support members are "C" channel shaped, constructed of 3/16 inch plate steel, and are welded directly onto the exterior surface of wall 41 at suitable points directed to the contact edges of each on the exterior surface of 41.

Figure 3A:
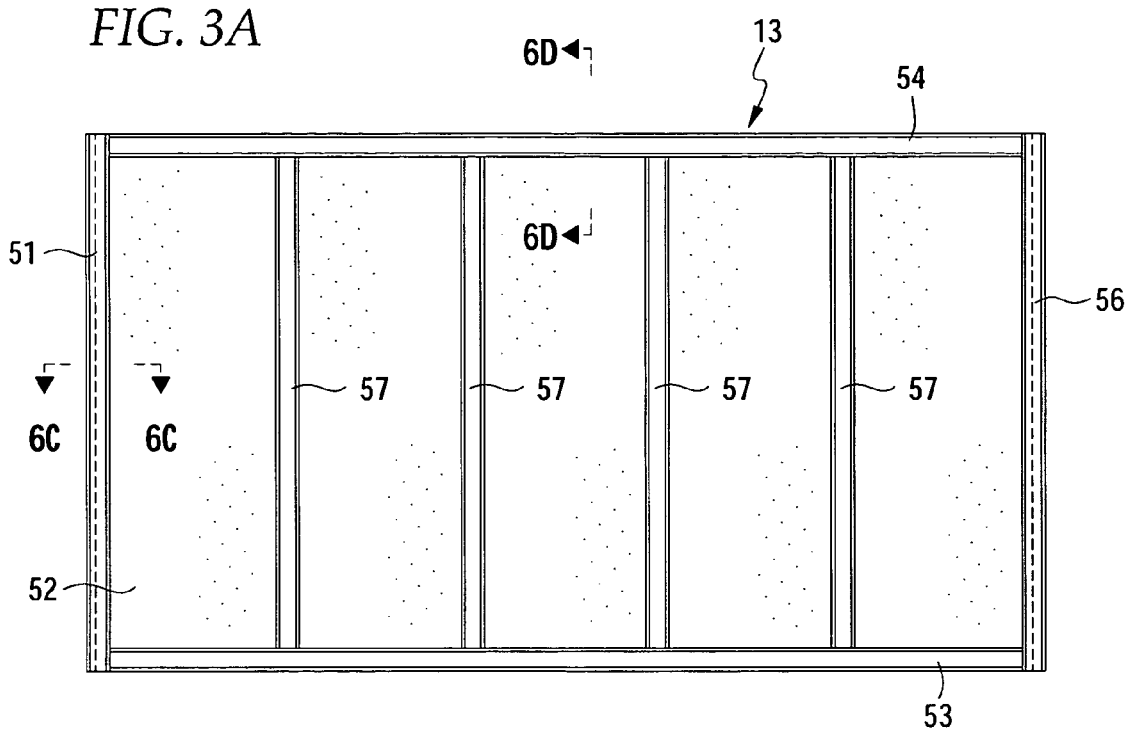
FIG. 3A is an elevational view of the right side panel of the invention as viewed from the exterior of the cell.
Figure 3B:
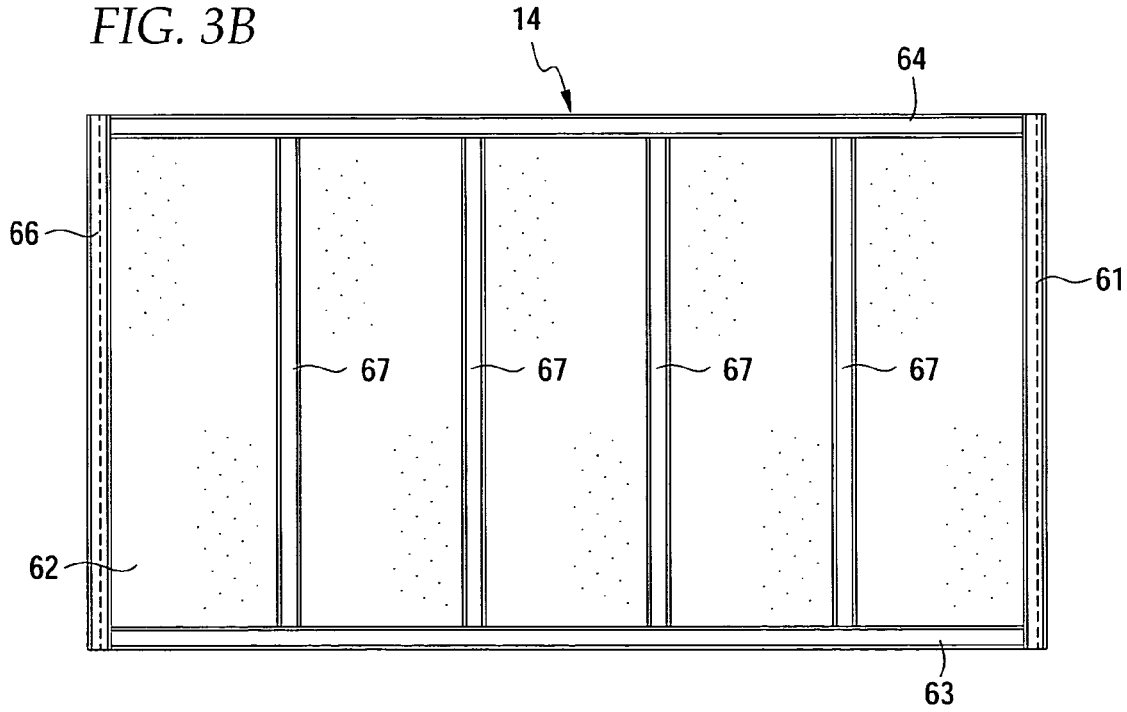
FIG. 3B is an elevational view of the left side panel of the invention as viewed from the exterior of the cell.

As shown in FIGS. 3A-B, right and left side panels 13, 14 consist of a smooth interior wall 52, 62 to which several support members are welded. Right side panel 13 is bounded on its upper edge with "C" channel support member 54 and at its lower edge by "C" channel member 53. Vertical "C" channel support members 57 are welded directly to the exterior of wall surface 52 at their contact edges and bear directly against edges of upper and lower support members 54, 53. Side support members 51, 56 bear against the ends of upper and lower support members 54, 53 and are welded onto partially extending wall surface 52 as shown. As will be discussed, wall surface 52 does not extend across the entire back surface of support members 51, 56 so that interconnections with front and rear panels 11, 12 fit more appropriately. Similarly, as shown in FIG. 3B, left side panel 14 includes upper and lower support members 64, 63, and support members 61, 66, and vertical inner support members 67. Each of these "C" channel support members are welded onto outer surface of wall 62 at suitable edge contact points. Interior wall 62 extends partially over the back portion of the support members 66, 61 to allow for connection with rear and front panels 12, 11.

Figure 4:
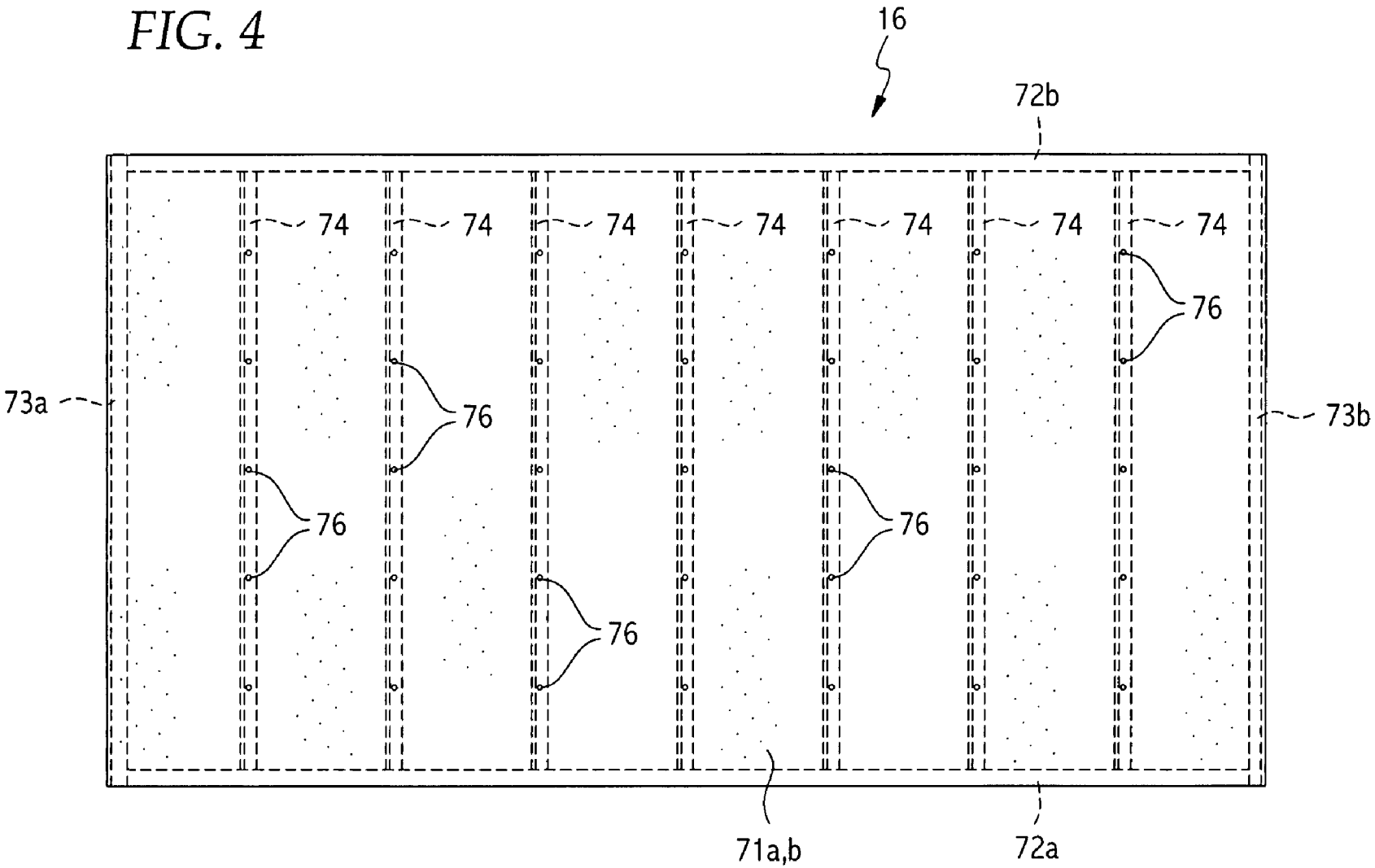
FIG. 4 is a plan view of a roof panel.

Referring now to the roof panel 16, as shown in FIG. 4, roof panel 16 is constructed of double walled exterior surfaces 71*a,b* and outer wall 71*b* includes weld apertures 76 so that welding of support members 74 can occur after placement of exterior wall surface 71*b* thereupon. Side support members 72*a,b* and end support members 73*a,b* bind the exterior perimeter of wall surfaces 71*a,b,* and lateral support members 74 are spaced evenly across the length of roof panel 16 to provide support therefor. Once "C" channel support members 72, 73, 74 are welded onto to interior wall surface 71*a,* exterior wall surface 71*b* is positioned to rest on top of support member 74 and weld holes 76 are aligned onto support members 74 and welded thereto.

Figure 5:
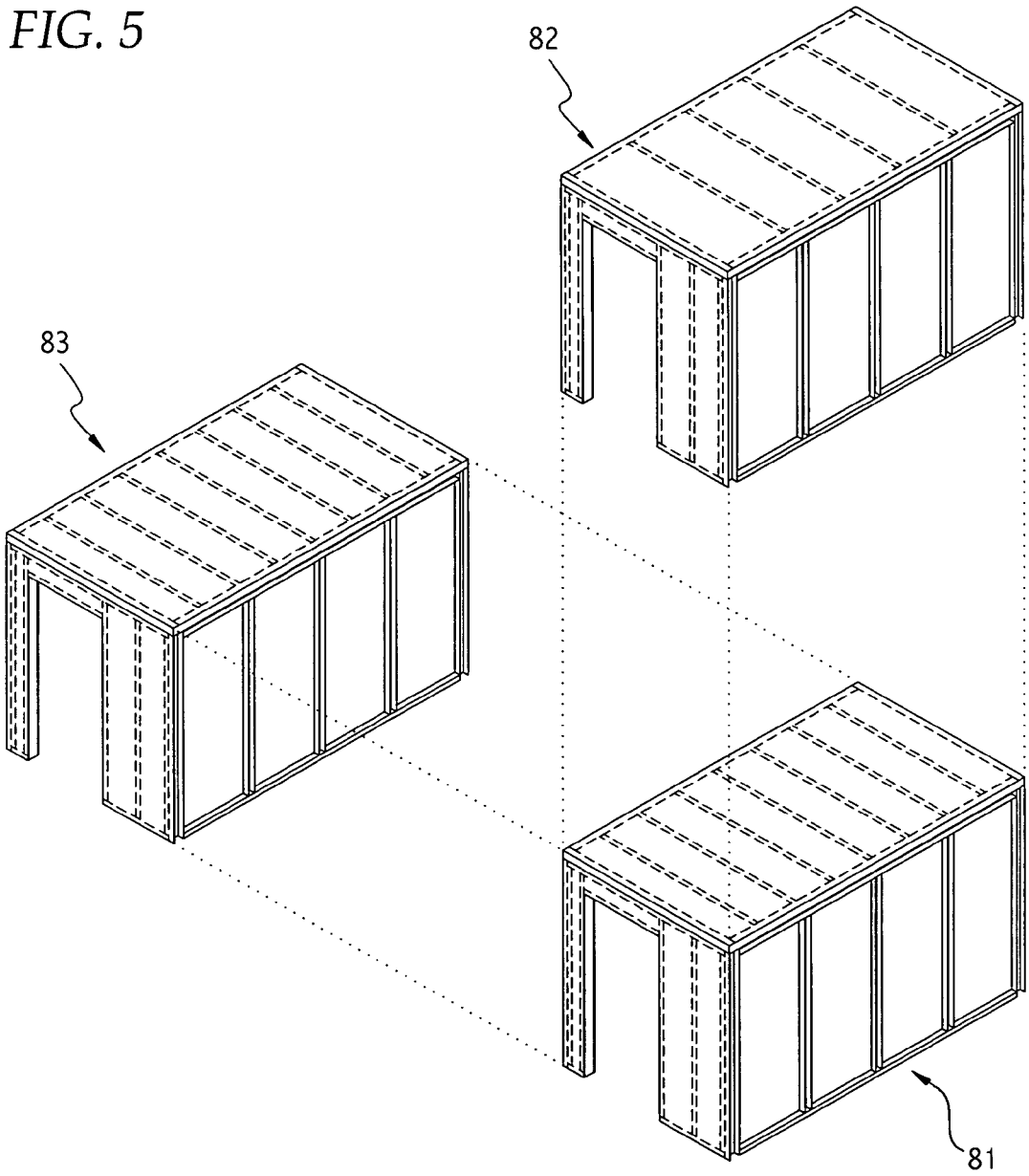
FIG. 5 is an exploded perspective view of three assembled jail cells interconnected to form a three cell system.

Referring now to FIG. 5, stacking and lateral positioning of multiple cells may be seen. As will be shown, cells 81 and 83 may be positioned adjacent to one another and locked together with interconnections structures and welded using standard welding techniques to form a rigid dual cell unit thereof. Similarly, superior cell 82 may be positioned on any ventrally positioned cell and dual wall constructed roof panel 16 of the ventrally located cell serves as the floor for superior cell unit 82. Due to the rigid support provided by multiple "C" channel support members for each cell within their upstanding panels, a number of cells may be positioned above one another to a maximum height, without reinforcing, of six cells. Lateral cell positioning may continue infinitely.

Figure 6A:
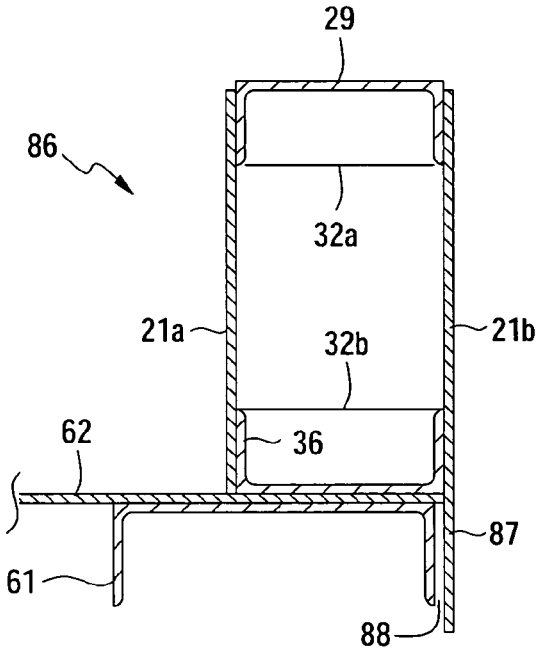
FIGS. 6A-6D are selected sectional views from FIGS. 1-4 showing interlocking structures; and, FIGS. 7A-7B are views showing the front and rear connecting structures for connecting multiple cells.

Referring now to FIGS. 6A-D, the panel inter-connecting structures and inter-cell connecting structures will be described. As seen in FIG. 6A, inter-connecting structures 86 allow for the joining of front panel 11 and left side panel 14. Exterior wall surface 21*b* extends beyond "C" channel support member 36 a length slightly longer than the width of "C" channel support member 61 as shown. Wall surface 62 is positioned against the backside surface of "C" channel support member 36 and bears against the inner surface of outer wall 21*b*. "C" channel support member 36 and wall surface 21*a* are affixed to left side panel inner wall surface 62 through standard welding techniques at suitable contact points, as is known in the art. As is seen, a channel void 88 of approximately ¼ of an inch is left open between outer wall extension 87 and the front portion of "C" channel support member 61 to allow for the connection of an adjacent cell outer wall 21*b* by interposing within both voids 88, 92 an interlock plate 107 (not shown) during installation of a preassembled cell onto a foundation, as will be described.

Figure 6B:
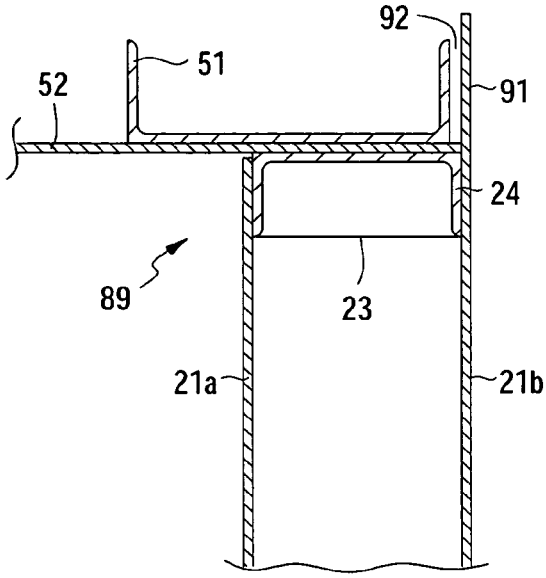

As is seen in FIG. 6B, right side panel 13 is connected to front panel 11 with connecting structures 89. Inner wall 52 of right side panel 13 is positioned against the backside of "C" channel support member 24 such that wall 52 also bears against outer wall 21*b* extension portion 91 to achieve a tight fit. The two are then welded together at interior extension points leaving a channel gap 92 to allow for the interconnection of two cells at their front panel locations. Specifically, front wall 21*b* extension portion 91 and front portion of "C" channel support member 51 define a slot or void 92 of approximately ¼ of an inch between them that is dimensioned to receive a portion of an interlock plate 107 (not shown) shared with a similarly dimensioned slot or void 88 of an adjacently positioned cell having complimentary structures (See FIG. 6A).

Figure 6C:
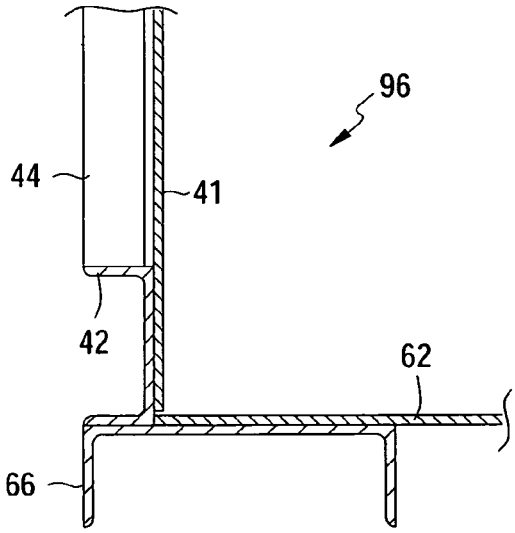

Referring now to FIG. 6C, it may be seen that left side panel 14 and rear panel 12 are connected at their lateral and rear edges. Rear side panel "C" channel support member 42 fits into a cooperatively dimensioned extending rear portion of "C" channel support member 66 such that inner wall surface 62 of left side panel 14 bears against a small rear portion of support member 42. Support member 42 is welded onto 41 to allow for enough space to accommodate 62 as shown, thereby having a portion of support member 42 extending slightly beyond inner wall surface 41 to allow for some movement during assembly. Inner surfaces of 62 and 41 are then welded together using traditional welding techniques, as well as support members 42 and 66.

Figure 6D:
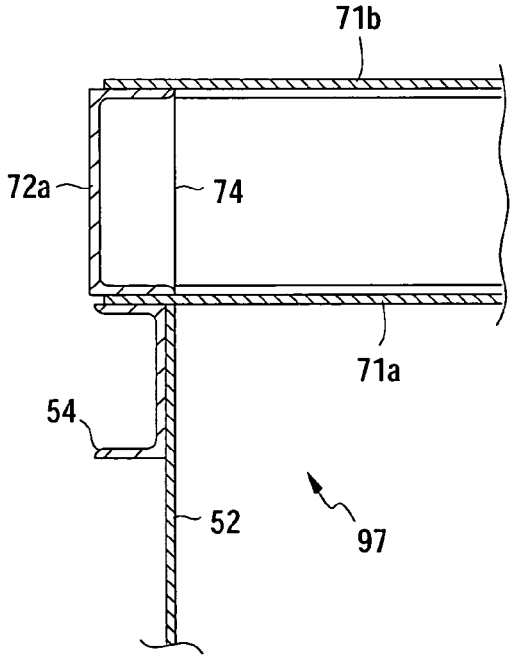

Referring now to FIG. 6D, interlocking structures 97 are provided to allow for the inter-connection and locking of roof panel 16 onto upper "C" channel support member 54 of right side panel 13. Upper support member 54 and inner wall 52 of side panel 13 are positioned such that a flush planer surface is presented to lower wall surface 71*a* of roof panel 16. As shown, "C" channel support member 72*a* is positioned above lower wall surface 71*a* to bear against (through 71*a*) and onto support member 54, which has been welded onto wall surface 52 and is supported by multiple vertical "C" channel support members 57 (not shown). Once roof panel 16 has been placed on and correctly positioned onto support member 54 and wall 52, roof panel 16 may be welded onto right side panel 13 at their contact points using traditional welding techniques. All of the upstanding front, rear and left panels have similar structures at their upper edges as in right side panel 13, and roof panel 16 is positioned onto and connected to these other upstanding panels in the same manner as with right side panel 13. Since roof panel 16 as shown in configuration 6D is double walled, wall surface 71*b* provides a suitable floor for a cell positioned above a prior constructed cell. Since the circumferential weight of a superiorly positioned cell is focused on the exterior of upstanding wall panels 11, 12, 13, 14, and because each of these panels 11-14 includes vertical "C" channel support members, multiple stages of up to five stories may be supported.

As discussed above in FIG. 6B, adjacent cells 81 and 83 are connected at their front panels via an interlock plate 107 filling voids 88 and 92, but some preparation of the concrete foundation underneath each cell is required to enable proper installation of each prefabricated cell in a level and secure manner. Initially, the concrete foundation of a proposed cell site is prepared by securing bearing plates to the concrete foundation with the use of expansion bolts that are driven into the concrete through apertures predrilled into each bearing plate. A bearing plate can vary in thickness, but a 3/16 inch thickness is preferred for most applications. Each bearing plate may be stacked one on top of another and are aligned through their apertures to allow for proper positioning of a cell onto the concrete slab foundation. Due to the variations in leveling of concrete slab foundations, varying numbers of bearing plates may be placed at each corner of an intended cell location to allow for proper leveling of a cell. Bearing plates in the front of the cell are rectangular in shape and are 3×6 inches in size, and rear bearing plates are typically 3×4 inches in diameter and 3/16 inches thick. Each plate is positioned on the concrete slab before a pre-constructed jail cell is lowered into place at a particular location such that the corners of the jail cell correspond with placement of the bearing plates. At the front panel of the cell, bearing plates do not extend beyond the exterior wall of the front and side panels, and placement corresponds with the rectangular dimension of the front cell corners. At the back panel of the cell, bearing plates overlap to some degree with adjacent cells and/or rear portions of the bearing plate may extend beyond the rear wall into a utility alleyway, if present, behind each cell. Once the exact locations of the cell have been marked on the bearing plates using standard marking techniques for steel, the bearing plates are secured to the foundation with an expansion bolt that has been driven through the aperture in the bearing plates. The head of the expansion bolt is then lowered to the plate surface level via a welding liquification process known in the art. After the bearing plates have been stacked to properly level each corner of the pre-fabricated jail cell, the pre-fabricated jail cell may then be lowered onto the bearing plate to provide a stable and level platform for placement over the cement foundation. Thereafter, standard welding techniques are utilized to weld the corners of the jail cell onto each bearing plate. The bearing plates also help to avoid shifting of individual cells during adjacent cell placement.

Figure 7A:
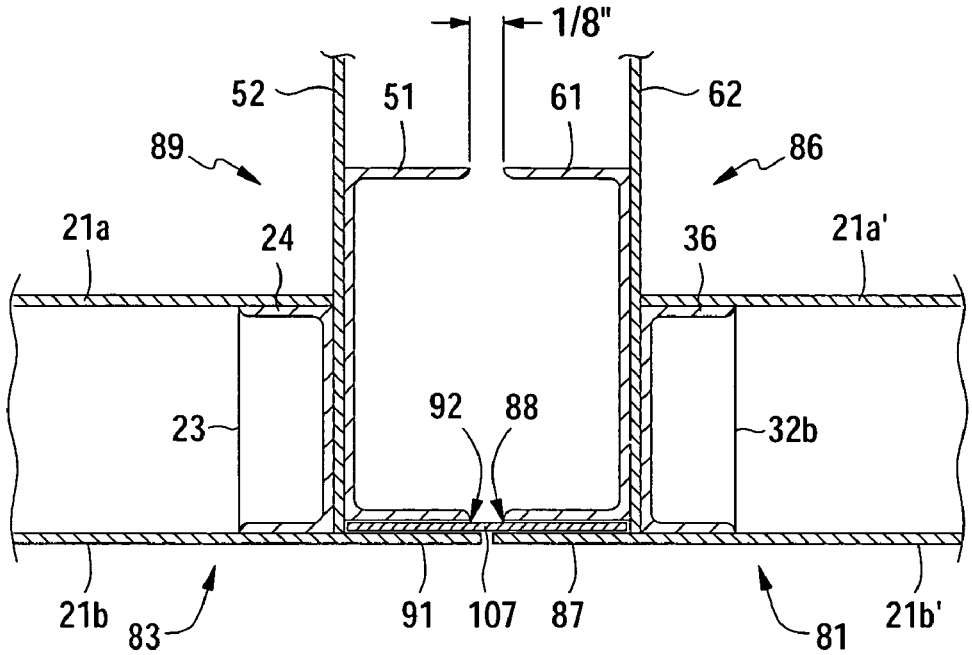

Once a single jail cell has been secured to the cement slab foundation and a second jail cell is positioned in readiness for interconnection with the installed jail cell, bearing plates are installed for the second cell in the same manner as described above and lowered into position adjacent to the existing cell, but left suspended above the bearing plates by a short distance of about 3-12 inches. An interlock plate of approximately 2½-3 inches in diameter and extending the height of the cell, is then inserted into gap 88 between wall 21*b* and side wall vertical support member 61 and advanced into the void 88 until the interlock plate 107 contacts side wall 62. The interlock plate 107 is preferably composed of A-36 grade steel and is 3/16 inches in thickness, as with other structures within each cell. The second cell is then swung slightly toward the installed cell and a worker uses the momentum of the second cell to align wall 21*b* with wall 21*b'* of the adjacent cell, and the interlock plate is urged into gap 92 covering the entire width of the interlock plate, which acts as a guide to align the two front walls 21*b* of each cell as well as the vertical "C" channel support member of side wall 61 of side wall 62. The second cell is then lowered onto the installed bearing plates being careful to align and bring together each respective side panel at the rear of the cell. Each side wall 21*b* and channel member 61 abut one another, but may be spaced up to approximately ⅛ of an inch apart to allow for thermal expansion. This creates a continuous surface front wall 21*b* across adjacent cells as illustrated in FIG. 7A.

Figure 7B:
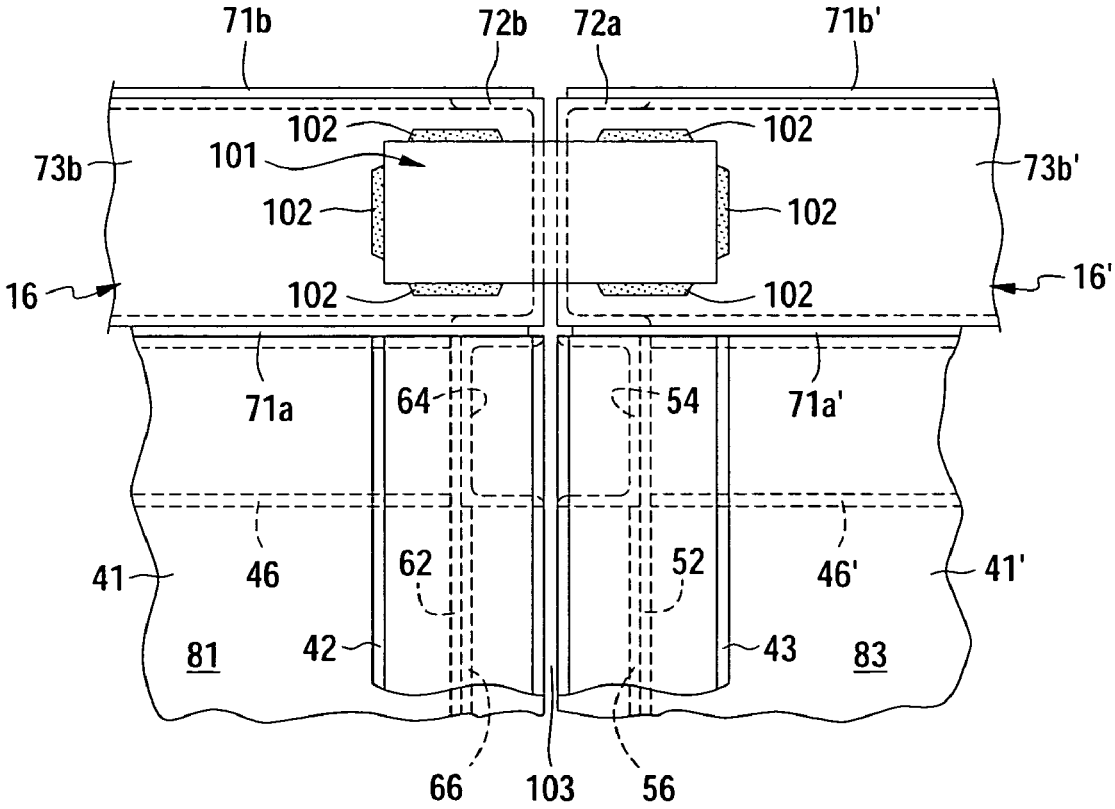

Once adjacent cells 81 and 83 have been secured to the foundation and connected together with interlocking plate 107, the rear of each cell is positioned such that right and left side panels are next to each other, but allowing approximately ⅛ space between upper horizontal support members 64 and 54, and vertical support members 67, 57. As shown in FIG. 7B, a connection cover plate 101 is then welded at the top corners of each rear cell corner to secure them together at weld points 102. Rear welding plates preferably have dimensions of 3×6 inches and are approximately ⅛ of an inch thick, such as found in available standard flat bar steel. The welding plate in a four cell configuration (e.g. 4 cells, 2 above 2) overlaps the four corners of each cell and has dimensions of 6×6 inches instead of the smaller two cell configuration, which only spans the upper edges of each panel. As will be understood, the rear connecting plate 101 and the front interlock plate 107 are welded onto each jail cell with standard welding techniques at appropriate contact points. While connection plate 101 is preferably welded between adjacent corners of each cell, other locations along adjacent structures of each cell also provide suitable connection points. For example, connection plates may be welded between rear support members of each side panel of adjacent panels at various locations along their lengths to achieve satisfactory connection results.

Vertical stacking of two cells 81, 82 is accomplished by positioning cell 82 directly on top of cell 81 such that front, rear, and side panels are vertically aligned. A 6 inch rear cover plate (e.g. a 6×6 inch version of plate 101) is welded to adjacent rear panels at the lower and upper corners respectively to secure location of cell 82 to cell 81, and bottom "C" channel support members of each upstanding panel are welded directly to underlying roof panel 16 at appropriate contacting points using standard welding techniques. Adjacent cells may be then laterally connected to cell 82 as with cells 81 and 83 to create a second row of cells connected to the installed lower row. This installation process may be replicated on successive superior cell rows to form a system of cells of up to 6 cells in height and unlimited cells in width.

While I shown my invention in one form, it will be obvious to those skilled in the art that it is not limited but is susceptible of various changes and modifications without departing from the spirit thereof.

Having set forth the nature of the invention, what is claimed is:

1. A prefabricated jail cell, comprising:

a. a front panel;

b. a rear panel;

c. two side panels joining said front and rear panel, wherein each said side panel presents a continuous interior wall surface toward the interior of said cell along its entire horizontal length from said front panel to said rear panel;

d. a roof panel joining said front, rear, and side panels at their upper edges;

e. wherein said jail cell includes first means for connecting said front panel and one of said side panels at their juncture to an adjacently positioned second cell;

f. wherein said jail cell includes second means for connecting said rear panel and one of said side panels at their juncture to an adjacently positioned second cell, and wherein said second means comprises a flat steel connecting plate welded over adjacent surface portions of each said roof panel;

g. wherein said cell includes an additional first means located on a side opposite from said other first means to enable said front panel to connect to an adjacently located third cell, and wherein said cell includes an additional second means located on a side opposite from said other second means to enable said rear panel to connect to an adjacently located third cell; and, h. wherein said first means comprises a front panel extension portion extending laterally outward from said front panel and a side panel support member spaced from said front panel extension portion and defining a slot positioned proximal to said extension portion and adapted to receive an interlock plate for connecting said first means to an adjacently positioned cell.

2. A jail cell as recited in claim 1, wherein said jail cell is configured to be attached to a plurality of other identical cells and said roof panel comprises two parallel steel sheets spaced from one another such that one of said sheets serves as a floor for a superiorly positioned cell.

3. A jail cell as recited in claim 2, wherein said front panel is double walled and each said wall of said front panel comprises a steel sheet spaced from one another.

4. A jail cell as recited in claim 3, wherein each said side panel comprises a single steel sheet facing an interior of said cell and includes at least two horizontal "C" channel shaped support members spanning the distance from the front to the rear of each side panel and a plurality of "C" channel shaped vertical support members and each connecting said horizontal support members together and spanning the distance there between, and wherein each said support member is welded upon the exterior surface of said steel sheet to provide reinforcement thereof.

5. A jail cell as recited in claim 4, wherein said front panel includes a horizontal "C" channel shaped support member at its upper edge thereof and said rear panel includes a horizontal "C" channel shaped support members at its upper edge thereof, and wherein one of said horizontal "C" channel shaped support members of each said side panel is positioned at an upper edge of each said side panel, and wherein said roof panel affixed to each said upper edge horizontal support member such that each said support member supports said roof panel thereupon.

6. A prefabricated jail cell, comprising:

a. a front panel;

b. a rear panel;

c. two side panels joining said front and rear panels, wherein each said side panel presents a continuous interior wall surface toward the interior of said jail cell along its entire horizontal length from said front panel to said rear panel;

d. a roof panel joining said front, rear, and side panels at their upper edges;

e. wherein said jail cell includes first means for connecting said front panel and one of said side panels at their juncture to an adjacently positioned second cell;

f. wherein said jail cell includes second means for connecting said rear panel and one of said side panels at their juncture to an adjacently positioned second cell, and wherein said second means comprises a flat metal connecting plate welded over adjacent surface portions of each said roof panel; and, g. wherein said first means comprises a front panel extension portion extending laterally outward from said front panel and a side panel support member spaced from said front panel extension portion and defining a slot positioned proximal to said extension portion and adapted to receive an interlock plate for connecting said first means to an adjacently positioned cell.

7. A jail cell as recited in claim 6, wherein said roof and front panels each comprise two opposing seamless metal sheet affixed to another by a plurality of parallel metal support brackets positioned between said sheets and including a horizontal metal support bracket at the upper and lower edges of said sheets.

8. A jail cell as recited in claim 7, wherein each said side panel and rear panel includes a plurality of "C" channel shaped vertical support members affixed to the exterior of said wall surface, and wherein said support brackets in said roof and front panels are "C" channel shaped.

9. A jail cell as recited in claim 8, wherein said jail cell is configured to be attached to a plurality of other identical cells and said roof panel serves as a floor for a superiorly positioned cell.

10. A jail cell as recited in claim 6, wherein the juncture of each said panel to another forms a 90 degree angle and where each said juncture of each said panel comprises a weldment of superimposed metal plates.

11. A jail cell as recited in claim 10, wherein said jail cell is configured to be attached to a plurality of other identical cells and said roof panel comprises two parallel metal sheets spaced from and affixed to one another through a plurality of metal brackets such that one of said metal sheets serves as a floor for a superiorly positioned cell.

12. A prefabricated jail cell, comprising:

a. a front panel;

b. a rear panel;

c. two side panels joining said front and rear panels, wherein each said panel comprises a single metal sheet;

d. a roof panel joining said front, rear, and side panels at their upper edges;

e. wherein said jail cell includes means for connecting said front panel to said side panels at their juncture;

f. wherein said jail cell is connected to an adjacently positioned second cell at the edges of their respective front panels through a weldment of a connecting plate on the interior of said front panel such that said connecting plate is hidden.

13. A jail cell as recited in claim 12, wherein each said side panel includes a plurality of "C" channel shaped vertical support members welded onto the exterior of said metal sheet of each panel and wherein said support members are positioned such that said channel of said support members is open toward an adjacently positioned jail cell.

14. A prefabricated jail cell, comprising:

a. a front panel;

b. a rear panel;

c. two side panels joining said front and rear panels, wherein each said side panel presents a continuous interior wall surface toward the interior of said jail cell along its entire horizontal length from said front panel to said rear panel, and further wherein each said side panel includes a plurality of "C" channel shaped vertical support members welded upon the exterior of said wall surface and positioned such that each said channel of said support member is open toward an adjacently positioned cell;

d. a roof panel joining said front, rear, and side panels at their upper edges;

e. wherein said jail cell includes first means for connecting said front panel and one of said side panels at their juncture to an adjacently positioned second cell;

f. wherein said jail cell includes second means for connecting said rear panel and one of said side panels at their juncture to an adjacently positioned second cell; and, g. wherein said jail cell is configured to be attached to a plurality of other identical cells and said roof panel includes two parallel metal walls spaced from one another with a series of metal brackets such that one of said metal walls serves as a floor for a superiorly positioned cell.

15. A system of connected prefabricated jail cells, comprising:

a. a first cell, comprising:

i. a front panel;

ii. a rear panel;

iii. two side panels joining said front and rear panels, wherein each said side panel presents a continuous interior wall surface toward the interior of said cell along its entire horizontal length from said front panel to said rear panel;

iv. a roof panel joining said front, rear, and side panels at their upper edges; and, v. wherein said first jail cell includes first means for connecting said front panel and one of said side panels at their juncture to an adjacently positioned cell;

b. a second cell positioned adjacent to said first cell and connected thereto through said first means;

c. a third cell positioned adjacent to said first cell on an opposite side from said second cell and connected to said front panel of said first cell;

d. a fourth cell positioned above said first cell and attached thereto, wherein said roof of said first cell serves as a floor of said fourth cell; and, e. wherein said jail cell is connected to each adjacently positioned cell at the edges of their respective front panels through a weldment of a connecting plate on the interior of said front panel such that said connecting plate is hidden.

16. A jail cell as recited in claim 15, wherein each said roof and front panels are double walled and each said wall comprises a single metal sheet.

17. A jail cell as recited in claim 16, wherein each said side panel includes a plurality of "C" channel shaped vertical support members to provide reinforcement and wherein each said vertical support member is welded upon the exterior surface of each metal sheet and positioned such that the channel of each support member opens away from the interior of said cell.

18. A jail cell as recited in claim 17, wherein each said front panel is double walled and each said wall of said front panel comprises a steel sheet spaced from one another.

19. A jail cell as recited in claim 15, wherein each said panel includes a plurality of "C" channel shaped vertical support members welded upon a wall surface opposite from the surface facing the interior of said cell.

20. A jail cell as recited in claim 19, wherein each said front panel includes an entrance way.

21. A prefabricated jail cell, comprising:

a. a front panel;

b. a rear panel;

c. two side panels joining said front and rear panels, wherein each said side panel presents a continuous rigid wall surface toward the interior of said cell along its entire horizontal length from said front panel to said rear panel;

d. a roof panel joining said front, rear, and side panels at their upper edges;

e. wherein said front panel includes an extension portion extending laterally outward from said front panel on each side and a side panel support member connected to said front panel and spaced rearwardly from said front panel extension portion defining a slot positioned proximal to said extension portion, said slot including a flat interlock plate cooperatively sized with said slot and welded therein for connecting to an adjacently positioned cell;

f. wherein each said side panel includes a wall surface and a "C" shaped side panel support member having an exterior surface welded to an exterior surface of said side panel and positioned such that the interior of said "C" support member opens away from the interior of said cell, and wherein said side panel includes a portion extending beyond said wall surface to provide a supporting surface to an end of said rear panel and affixed thereto; and, g. wherein each said front, rear, and two side panels each includes a "C" channel lateral support member at their upper edges and positioned such that a longitudinal side surface of said support member affixed to said roof panel along its entire length for supporting said same.

22. A prefabricated jail cell, comprising:

a. a front panel;

b. a rear panel;

c. two side panels joining said front and rear panels, wherein each said side panel presents a continuous and seamless rigid wall surface toward the interior of said cell from said front panel to said rear panel;

d. a roof panel joining said front, rear, and side panels at their upper edges;

e. wherein each said panel comprises a single metal sheet facing the interior of said cell and includes a plurality of vertical "C" channel shaped support members welded upon the exterior of said metal sheet and spanning the distance from the bottom of each said panel its top;

f. wherein the juncture of each said panel to another forms a 90 degree angle and where each said juncture of each said panel comprises a weldment of superimposed flat metal plates.

23. A jail cell as recited in claim 22, wherein said front panel includes a horizontal "C" channel shaped support members at its upper edge thereof and said rear panel includes a horizontal "C" channel shaped support members at its upper edge thereof, and wherein each said side panel includes a horizontal "C" channel shaped support member at its upper edge thereof, and wherein said roof panel is positioned upon each said upper edge horizontal support member such that each said support member supports said roof panel thereupon.

* * * * *